US008517155B2

(12) United States Patent
Tong

(10) Patent No.: US 8,517,155 B2
(45) Date of Patent: Aug. 27, 2013

(54) MOBILE BASE FOR LUGGAGE CASE

(76) Inventor: Joy Tong, Boca Raton, FL (US)

( * ) Notice: Subject to any disclaimer, the term of this patent is extended or adjusted under 35 U.S.C. 154(b) by 579 days.

(21) Appl. No.: 12/714,511

(22) Filed: Feb. 28, 2010

(65) Prior Publication Data

US 2011/0209959 A1 Sep. 1, 2011

(51) Int. Cl.
*A45C 13/00* (2006.01)

(52) U.S. Cl.
USPC ..... 190/18 A; 190/18 R; 190/11; 280/37; 280/47.135; 16/429; 206/373; 206/45.24; 211/134; 248/289.11; 248/231.71

(58) Field of Classification Search
USPC ..... 190/18 A, 18 R, 11; 280/37, 47.315; 16/429; 128/92 B
See application file for complete search history.

(56) References Cited

U.S. PATENT DOCUMENTS 3,741,205 A * 6/1973 Markolf et al. ..... 606/291
4,244,632 A * 1/1981 Molinari ..... 312/231
5,460,393 A * 10/1995 Tsai ..... 280/655
5,586,628 A * 12/1996 Wang ..... 190/115
5,819,891 A * 10/1998 Wang et al. ..... 190/103
6,405,842 B1 * 6/2002 Tsai ..... 190/18 R
6,761,274 B1 * 7/2004 Chen ..... 211/207
6,908,087 B2 * 6/2005 Wintersgill et al. ..... 280/33.991
7,021,436 B2 * 4/2006 Hoberman et al. ..... 190/18 R
7,175,002 B2 * 2/2007 Chiang ..... 188/1.12
7,240,909 B2 * 7/2007 Robens ..... 280/47.24
7,748,508 B2 * 7/2010 Lee et al. ..... 190/18 A

* cited by examiner

*Primary Examiner* — Anthony Stashick
*Assistant Examiner* — Cynthia Collado
(74) *Attorney, Agent, or Firm* — Pai Patent & Trademark Law Firm; Chao-Chang David Pai

(57) ABSTRACT

A mobile base for a luggage case includes a base and two supports. The base includes two aligned sleeves. Each of the sleeves has an inner threaded hole at a central portion thereof. The two supports are movably connected to the sleeves. Each of the supports has a cylinder and an outer threaded section. The outer threaded section is adapted to engage with the inner threaded hole. Thereby, the mobile base of the present invention is suitable for various luggage cases, providing an easy and convenient adjustment.

5 Claims, 5 Drawing Sheets

MOBILE BASE FOR LUGGAGE CASE

BACKGROUND OF THE INVENTION (a) Field of the Invention

The present invention relates to a mobile case for a luggage case, and more particularly to a mobile base having an adjustable support for corresponding to a luggage case with a wheel in a different diameter so as to support the luggage case steadily.

(b) Description of the Prior Art

A conventional luggage case is provided with a retractable handle at the back of the luggage case for the user to drag the luggage case with ease. The luggage case is coupled with two wheels at the bottom near the back of the luggage case, and two foot pads are provided at the bottom near the front of the luggage case. When the luggage case is pulled obliquely, the luggage case will be dragged on the ground through the movement of the wheels. When the luggage case needs to be placed upright, the two wheels and the two foot pads form four balance points to support the luggage case. However, the conventional wheels have different diameters. The foot pads have to be made in different sizes so as to correspond in size to the relative wheels, such that the foot pads and the wheels can form four balance points to support the luggage case. Therefore, it is necessary to have a new mold for a foot pad in a different size. This increases the production cost and it is not easy to manage the parts. Accordingly, the inventor of the present invention has devoted himself based on his many years of practical experiences to develop a mobile base adapted for various wheels so as to support the luggage case steadily.

SUMMARY OF THE INVENTION

The primary object of the present invention is to provide a mobile base for a luggage case, which comprises a base and two moveable supports to be inserted in two sleeves of the base. The length of the support is adjustable to extend out from the sleeve for corresponding to a luggage case with a wheel in a different diameter. The present invention can lower the cost and apply to various luggage cases, providing an easy and convenient adjustment.

In order to achieve the aforesaid object, a mobile base for a luggage case of the preset invention includes a base and two supports. The base includes two aligned sleeves. Each of the sleeves has an inner threaded hole at a central portion thereof. The two supports are movably connected to the sleeves. Each of the supports has a cylinder and an outer threaded section. The outer threaded section is adapted to engage with the inner threaded hole. Thereby, the mobile base of the present invention is suitable for various luggage cases, providing an easy and convenient adjustment.

For the support to be turned easily, one end of each of the supports is formed with the outer threaded section, and another other end of each of the supports is formed with a plurality of notches to constitute a first repoussé, such that the user can hold the first repoussé to turn the support for adjusting the length of the cylinder of the support to extend out from the sleeve. In order to prevent the support from disengaging form the sleeve, the outer threaded section of each of the supports has a diameter greater than that of the cylinder. The inner threaded hole of each of the sleeves is formed with an inner stop ring at one end thereof. The inner stop ring is adapted to stop the outer threaded section of each of the supports. For the sleeve to be coupled with the bottom of the luggage case, a connecting rod is provided between the two sleeves. One side of each of the sleeves is provided with a fixing plate. The fixing plate has at least one fixing hole thereon. An outer surface of each of the sleeves is formed with a plurality of notches to constitute a second repoussé.

The mobile base of the present invention can be mounted to the bottom of a luggage case with a wheel in a different diameter. By turning the support, the length of the support is adjustable to extend out from the sleeve for corresponding to the diameter of the wheel so as to support the luggage case steadily. The mobile base of the present invention is suitable for various luggage cases, providing an easy and convenient adjustment.

DETAILED DESCRIPTION OF THE PREFERRED EMBODIMENTS

Embodiments of the present invention will now be described, by way of example only, with reference to the accompanying drawings.

Figure 1:
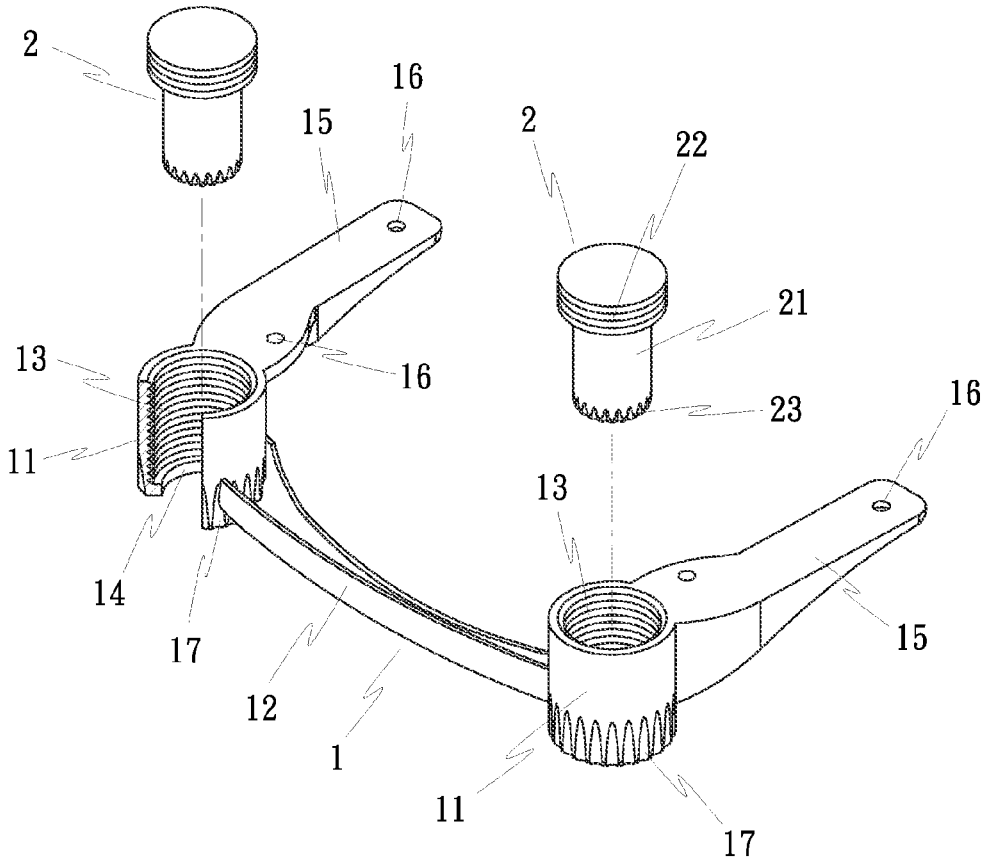
FIG. 1 is an exploded view of a preferred embodiment of the present invention.
Figure 2:
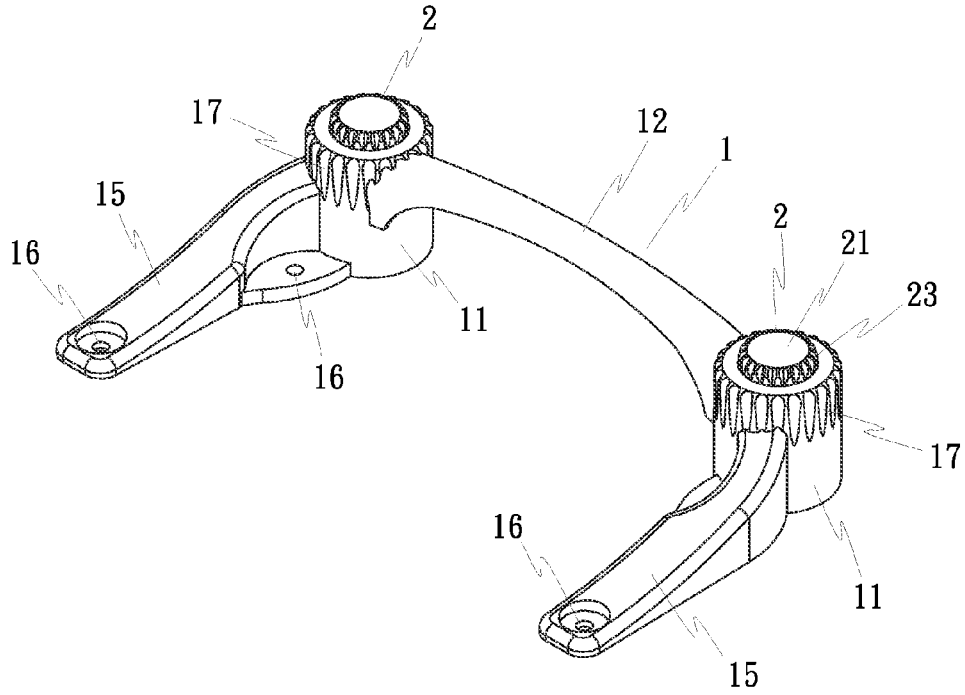
FIG. 2 is a perspective view of the preferred embodiment of the present invention.
Figure 3:
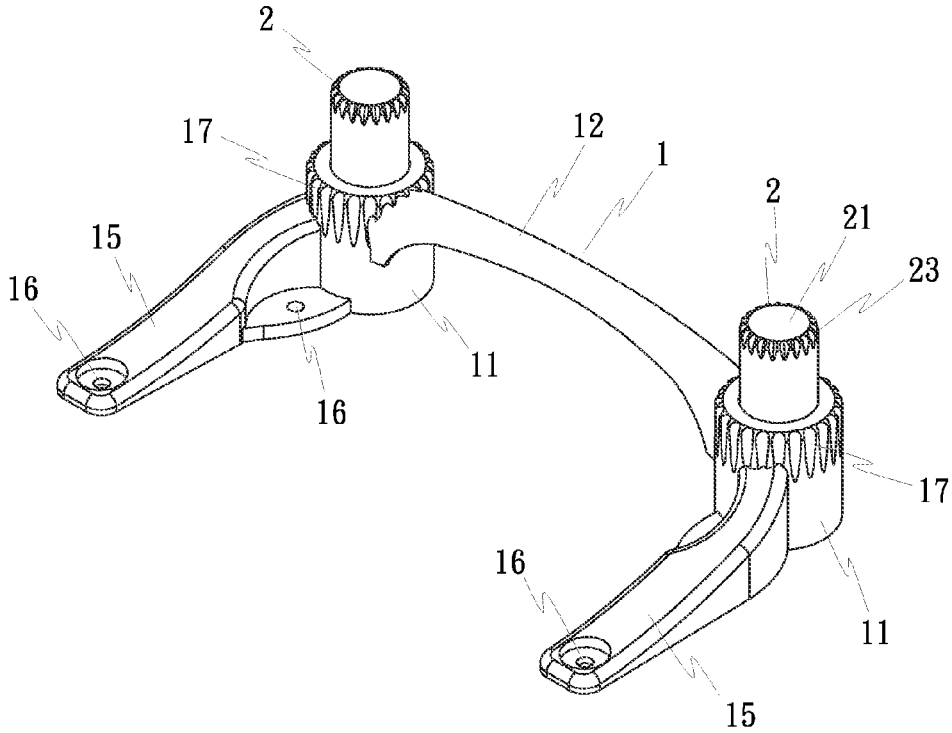
FIG. 3 is another perspective view of the preferred embodiment of the present invention.

As shown in FIG. 1 to FIG. 3, a mobile base for a luggage case according to a preferred embodiment of the present invention comprises a base 1 and two supports 2. The base 1 includes two aligned sleeves 11 in a circular shape or other shape and a connecting rod 12 disposed between the two sleeves 11. Each of the sleeves 11 has an inner threaded hole 13 at a central portion thereof. The two supports 2 are movably connected to the sleeves 11. Each of the supports 2 has a cylinder 21 in a circular shape or other shape and an outer threaded section 22. The outer threaded section 22 is adapted to engage with the inner threaded hole 13. The support 2 can be turned to adjust the length of the support 21 for extending out from the sleeve 11 to be the mobile base of the luggage case.

Figure 4:
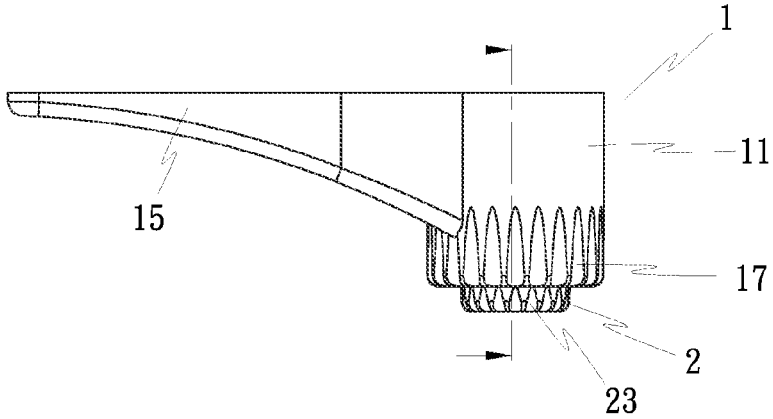
FIG. 4 is a side view of the preferred embodiment of the present invention.
Figure 5:
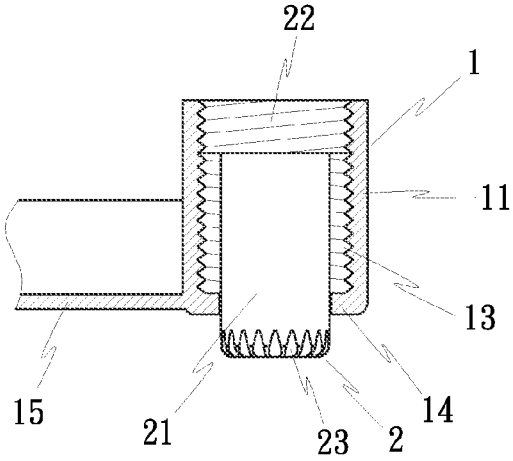
FIG. 5 is a cross-sectional view of the preferred embodiment of the present invention.
Figure 6:
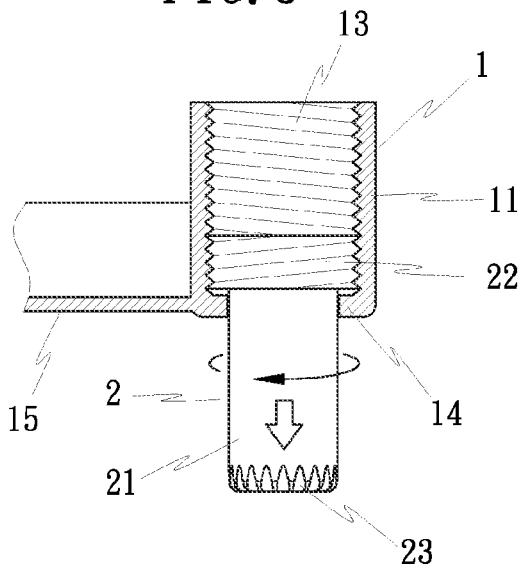
FIG. 6 is a cross-sectional view of the preferred embodiment of the present invention in an operating status.

As shown in FIG. 1, one end of the support 2 is formed with the outer threaded section 22, and another end of the support 2 is formed with a plurality of notches to constitute a first repoussé 23, such that the user can hold the first repoussé 23 with his/her fingers or a tool to turn the support 2 for adjusting the length of the cylinder 21 of the support 2 to extend out from the sleeve 11. As shown in FIG. 4 and FIG. 5, in order to prevent the support 2 from disengaging from the sleeve 11, the outer threaded section 22 of the support 2 has a diameter greater than that of the cylinder 21. The inner threaded hole 13 of sleeve 11 is formed with an inner stop ring 14 at one end thereof. When the support 2 is turned to extend out from the sleeve 11, as shown in FIG. 6, the inner stop ring 14 will stop the end of the outer threaded section 22 of the support 2 so as to prevent the support 2 from disengaging from the sleeve 11. As shown in FIG. 1 and FIG. 2, for the sleeve 11 to be coupled with the bottom of the luggage case, one side of each of the sleeves 11 is provided with a fixing plate 15. The fixing plate 15 has at least one fixing hole 16 thereon for the luggage case to be coupled on the fixing plate 15. As shown in FIG. 1 and FIG. 2, an outer surface of each of the sleeves 11 is formed with a plurality of notches to constitute a second repoussé 17 for a visual effect.

Figure 7:
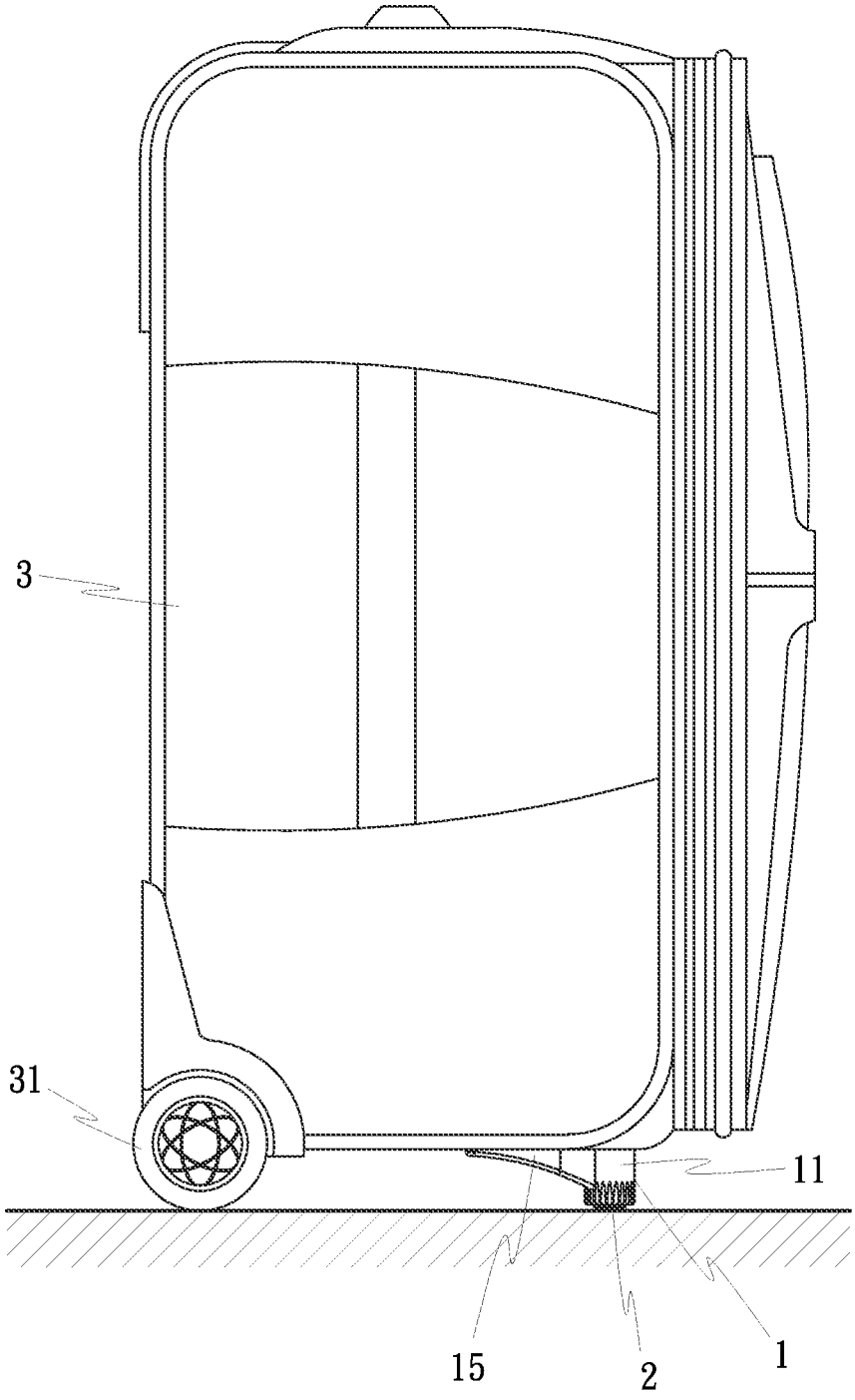
FIG. 7 is a schematic view of the preferred embodiment of the present invention when in use.
Figure 8:
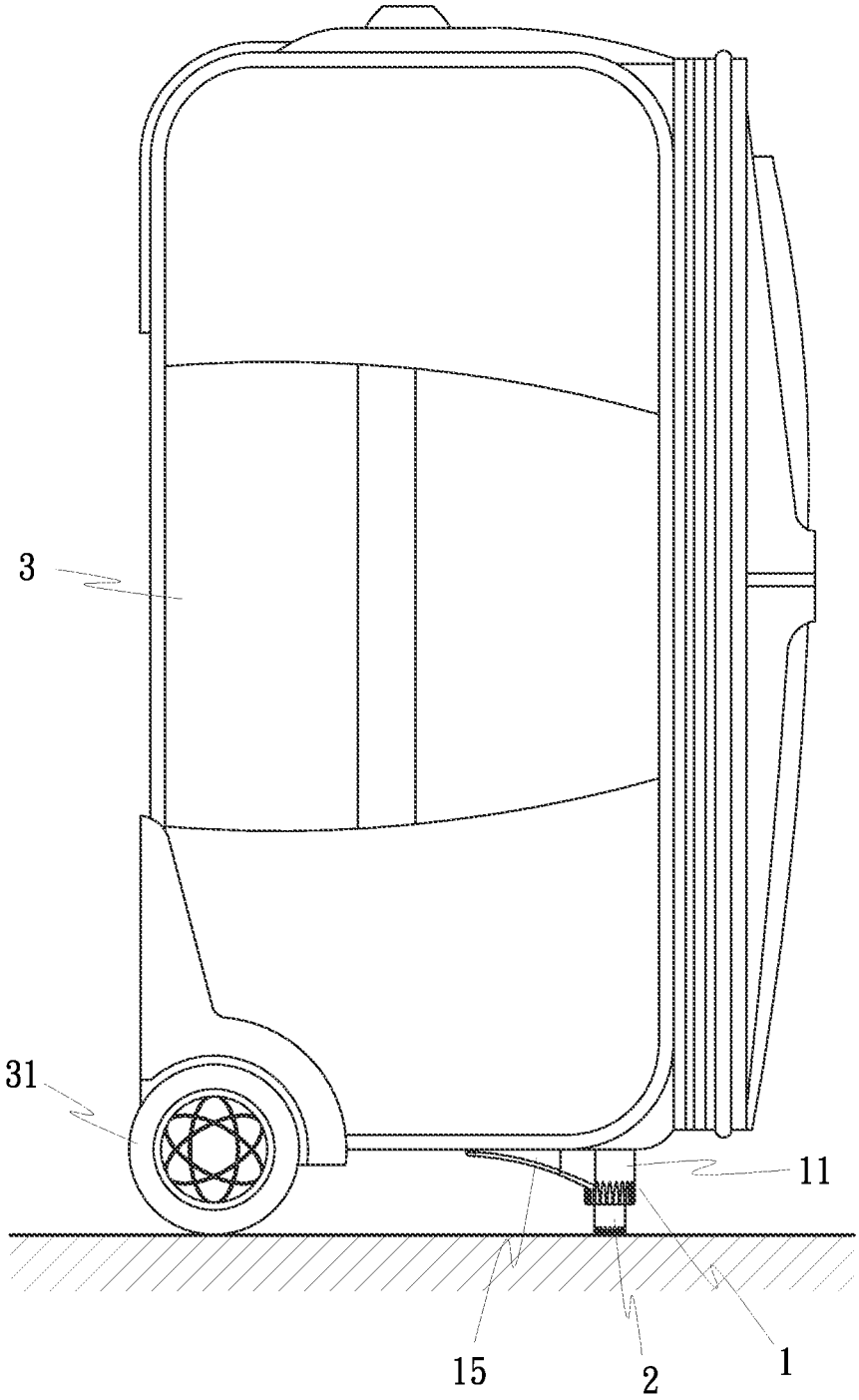
FIG. 8 is another schematic view of the preferred embodiment of the present invention when in use.

To practice the present invention, as shown in FIG. 7 and FIG. 8, the bottom of a luggage case 3 is coupled with the fixing plate 15 and the fixing hole 16. The cylinder 21 of the support 2 faces downward. Through the outer threaded section 22 and the inner threaded hole 13, the support 2 can be turned to adjust its length to extend out from the sleeve 11 for corresponding to the diameter of a wheel 31 of the luggage case 3, such that the support 2 and the wheel 31 are used to support the luggage case 3. As shown in FIG. 7, when the wheel 31 of the luggage case 3 is in a small size, the support 2 is retracted in the sleeve 11 to correspond to the small wheel 31 of the luggage case 3. As shown in FIG. 8, when the wheel 31 of the luggage case 3 is in a large size, the support 2 is extended out form the sleeve 11 to correspond to the large wheel 31 of the luggage case 3. Accordingly, the mobile base of the luggage case of the present invention is suitable for various wheels 31 in different sizes. The present invention can lower the cost and apply to various luggage cases, providing an easy and convenient adjustment.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A mobile base for a luggage case, comprising a base and two supports, the base including two aligned sleeves, each of the sleeves having an inner threaded hole at a central portion thereof, the two supports being movably connected to the sleeves, each of the supports having an unthreaded cylinder and an outer threaded section, the outer threaded section being adapted to engage with the inner threaded hole, wherein the inner threaded hole is longer than the outer threaded section for allowing the outer threaded section to be adjusted to various positions within the inner threaded hole, and wherein the outer threaded section of each of the supports has a diameter greater than that of the unthreaded cylinder, and the inner threaded hole of each of the sleeves is formed with an inner stop ring at one end thereof for stopping the outer threaded section of each of the supports while allowing the unthreaded cylinder to extend out of the sleeve.

2. The mobile base for a luggage case as claimed in claim 1, wherein one end of each of the supports is formed with the outer threaded section, and another other end of each of the supports is formed with a plurality of notches to constitute a first repoussé for holding while turning the support to adjust the length of the unthreaded cylinder extending out of the sleeve.

3. The mobile base for a luggage case as claimed in claim 1, wherein a connecting rod is provided between the two sleeves.

4. The mobile base for a luggage case as claimed in claim 1, wherein one side of each of the sleeves is provided with a fixing plate, and the fixing plate has at least one fixing hole thereon for fixing to a luggage case.

5. The mobile base for a luggage case as claimed in claim 1, wherein an outer surface of each of the sleeves is formed with a plurality of notches to constitute a second repoussé.

* * * * *